US006409266B1

(12) United States Patent
Chen

(10) Patent No.: US 6,409,266 B1
(45) Date of Patent: Jun. 25, 2002

(54) DEVICE FOR ADJUSTING LATERAL POSITION OF A CHAIR ARMREST

(76) Inventor: Su-Jan Chen, P.O. Box 63-247, Taichung (TW)

( * ) Notice: Subject to any disclaimer, the term of this patent is extended or adjusted under 35 U.S.C. 154(b) by 0 days.

(21) Appl. No.: 09/716,647

(22) Filed: Nov. 21, 2000

(51) Int. Cl.[7] ..... A47C 7/54

(52) U.S. Cl. ..... 297/411.37; 297/383; 297/411.35

(58) Field of Search ..... 297/411.37, 383, 297/353, 411.35

(56) References Cited

U.S. PATENT DOCUMENTS 5,338,133 A * 8/1994 Tornero ..... 297/411.37
5,462,338 A * 10/1995 Baumann ..... 297/411.37
5,839,784 A * 11/1998 Breen ..... 297/411.37
5,944,387 A * 8/1999 Stumpf ..... 297/411.37 X

* cited by examiner

*Primary Examiner*—Anthony D. Barfield
(74) *Attorney, Agent, or Firm*—Alan Kamrath; Rider, Bennett, Egan & Arundel, LLP

(57) ABSTRACT

A device for adjusting lateral position of a chair armrest relative to a chair seat comprises a base securely attached to the chair seat and having a number of positioning holes, an extension extended from an armrest of the chair and slidably received in the base along a lateral direction relative to the seat, and a positioning member including an intermediate portion pivotally attached to the extension, a first operative end, and a second end releasably engaged with at least one of the positioning holes. A mounting member is mounted to the underside of the positioning member and has a stub extended through a through-hole in the intermediate portion of the positioning member. A bolt is extended through the stub and engaged with the extension, thereby pivotally mounting the positioning member between the extension and the mounting member.

16 Claims, 7 Drawing Sheets

DEVICE FOR ADJUSTING LATERAL POSITION OF A CHAIR ARMREST

BACKGROUND OF THE INVENTION

1. Field of the Invention

The present invention relates to a device for adjusting lateral position of a chair armrest in response to the size of the user.

2. Description of the Related Art

FIGS. 7 and 8 of the drawings illustrate a conventional device for adjusting lateral position of a chair armrest. The adjusting device includes an armrest with an extension 21', a press member 22' pivotally mounted to the extension 21' by a pin 211' and having a first end with a protrusion 222' and a second press end 221', an outer sleeve 23', and an inner sleeve 24' that is mounted in the outer sleeve 23'. The inner sleeve 24' and the outer sleeve 23' are secured to an underside of a seat 3'. The outer sleeve 23' has an elongated hole 232' and the inner sleeve 24' includes a plurality of consecutive positioning holes 244', wherein each two adjacent positioning holes 244' are connected by a neck portion (not labeled). As illustrated in FIG. 8, the press member 22' is biased by a spring 212' such that the protrusion 222' is extended through the elongated hole 232' and engaged with one of the positioning holes 244'. When adjustment of lateral position of the armrest is required, the press end 221' is pressed to overcome the spring force causing the protrusion 222' to be disengaged from the positioning hole 244'. The armrest is then moved laterally relative to the seat 3' to a desired position, and the press end 221' is then released to cause the protrusion 222' to engage with an associated positioning hole 244'.

However, the inner sleeve 24' must be fittingly engaged in the outer sleeve 23' and this requires high-precision processing. In addition, it is found that the protrusion 222' cannot be smoothly guided into the positioning hole 244'. Furthermore, engagement of the protrusion 222' with the positioning hole 244' is not reliable such that the whole armrest extension 21' might be completely disengaged from the sleeves 23' and 24' when a relatively large force is applied to move the armrest extension 21' outward. The user might thus be injured.

SUMMARY OF THE INVENTION

It is the primary object of the present invention to provide an improved device for adjusting lateral position of a chair armrest in response to the size of the user, wherein the armrest is reliably retained in place after adjustment in a lateral position thereof.

In accordance with one aspect of the invention, a device for adjusting lateral position of an armrest of a chair relative to a seat of the chair comprises:

- a base securely attached to a seat of a chair, the base including a plurality of positioning holes;
- an extension extended from an armrest of the chair, the extension being slidably received in the base and slidable in a lateral direction relative to the seat;
- a positioning member including an intermediate portion pivotally attached to the extension, a first operative end, and a second end releasably engaged with at least one of the positioning holes, and
- means for preventing disengagement of the extension from the base during sliding movement of the extension relative to the seat.

The extension includes an opening and the second end of the positioning member includes two protrusions that are extended through the opening and releasably engaged with two of the positioning holes of the base. The base includes a screw hole. The positioning member includes a recessed area in an intermediate portion of an underside thereof, the recessed area having a through-hole. A mounting member is mounted to the recessed area of the positioning member and has a stub extended through the through-hole. A bolt is extended through the stub and engaged with the screw hole, thereby pivotally mounting the positioning member between the extension and the mounting member. The extension further includes at least one engaging hole, and the mounting member includes at least one peg for engaging with the engaging hole. An elastic element has a coil portion mounted around the stub of the mounting member, a first leg attached to the positioning member, and a second leg attached to the mounting member.

In an embodiment of the invention, the extension includes two engaging holes. The mounting member includes two lateral walls each having a peg for engaging with an associated engaging hole. An elastic element has a coil portion mounted around the stub of the mounting member, a first leg attached to one of the lateral wall of the positioning member, and a second leg attached to the mounting member.

The preventing means includes a screw hole defined in the extension, a screw engaged with the screw hole, and a stop formed on the base for engaging with the screw when the extension is moved to an outmost position relative to the seat of the chair. Preferably, each positioning hole of the base includes two lateral guiding sides for guiding the protrusions of the positioning member.

In accordance with a second aspect of the invention, a device for adjusting lateral position of an armrest of a chair relative to a seat of the chair comprises:

- a base securely attached to a seat of a chair, the base including a plurality of positioning holes;
- an extension extended from an armrest of the chair, the extension being slidably received in the base and slidable in a lateral direction relative to the seat;
- a positioning member including an intermediate portion pivotally attached to the extension, a first operative end, and a second end releasably engaged with at least one of the positioning holes, the positioning member further including an underside and a through-hole in an intermediate portion thereof;
- a mounting member mounted to the underside of the positioning member and having a stub extended through the through-hole;
- a bolt extended through the stub and engaged with the extension, thereby pivotally mounting the positioning member between the extension and the mounting member.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
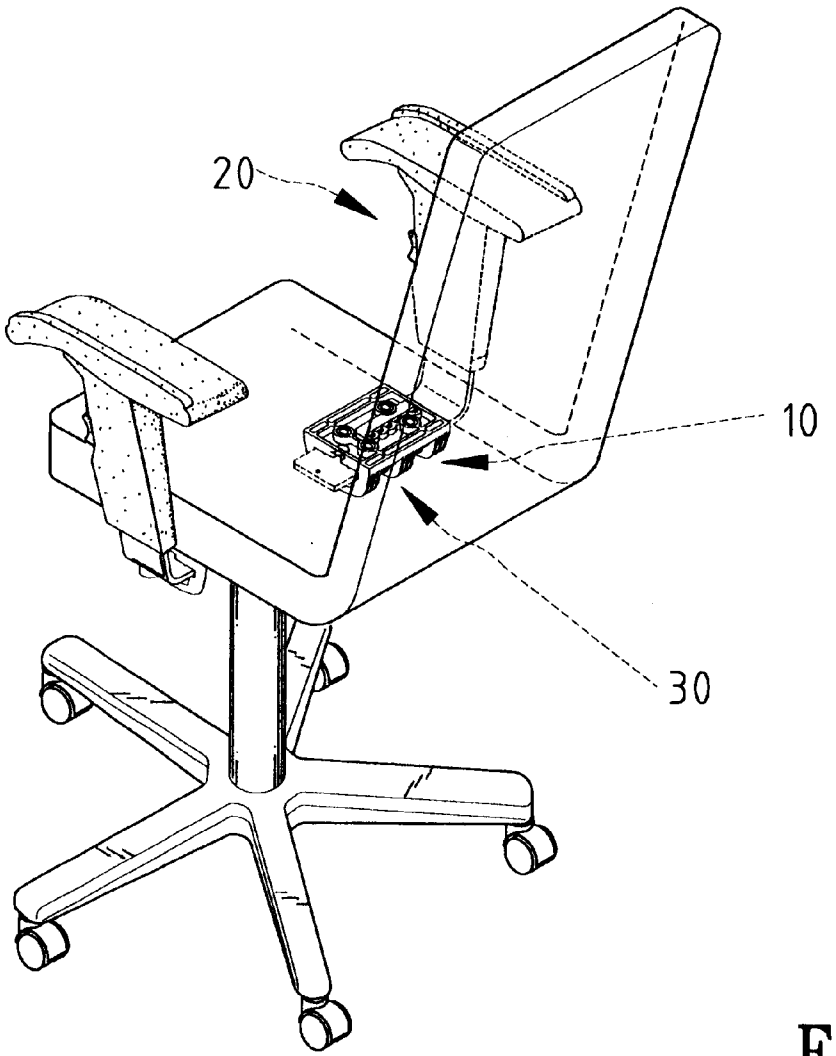
FIG. 1 is a perspective view of a chair with an armrest adjusting device in accordance with the present invention.
Figure 2:
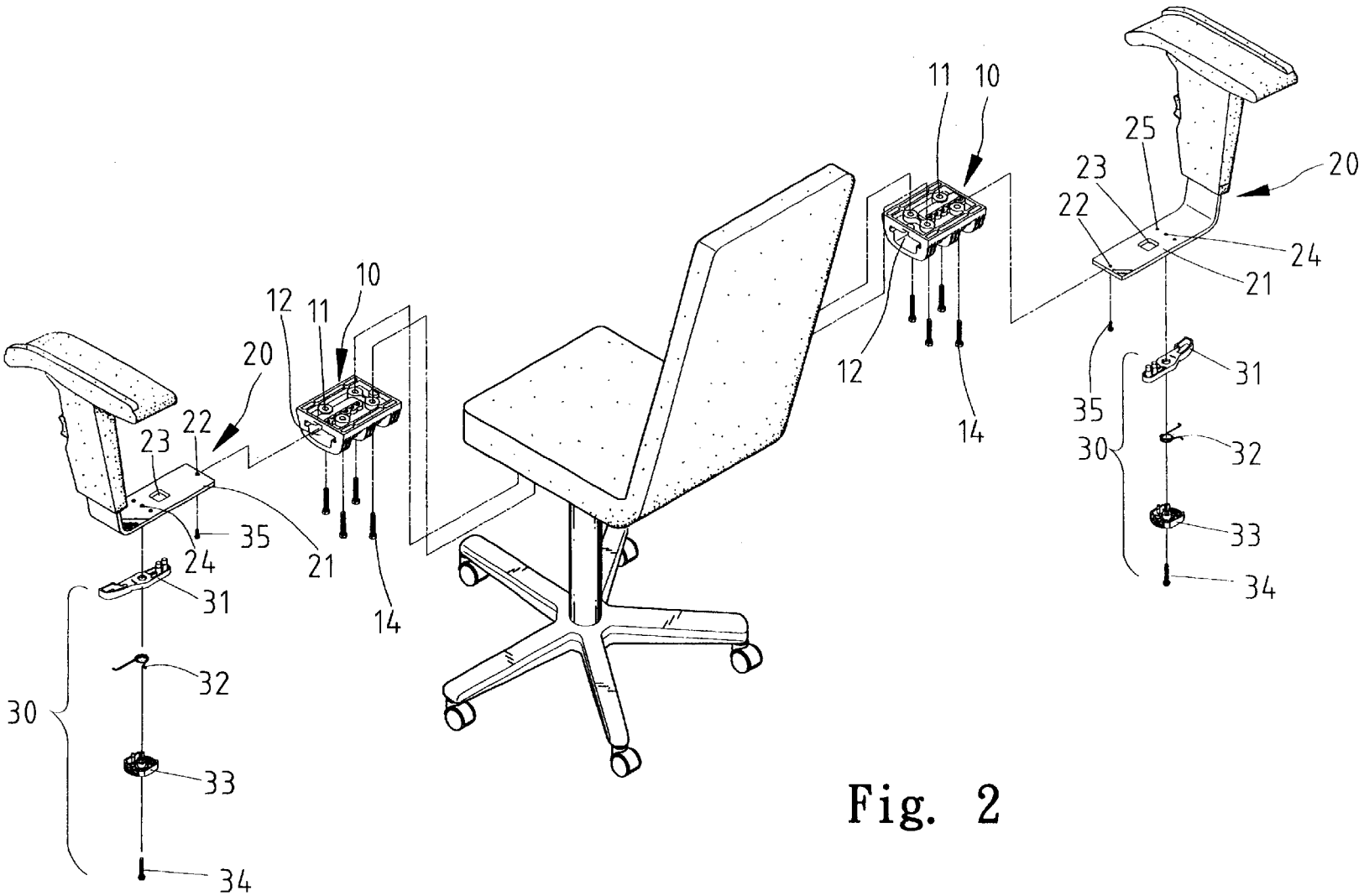
FIG. 2 is an exploded perspective view of the chair in FIG. 2.
Figure 3:
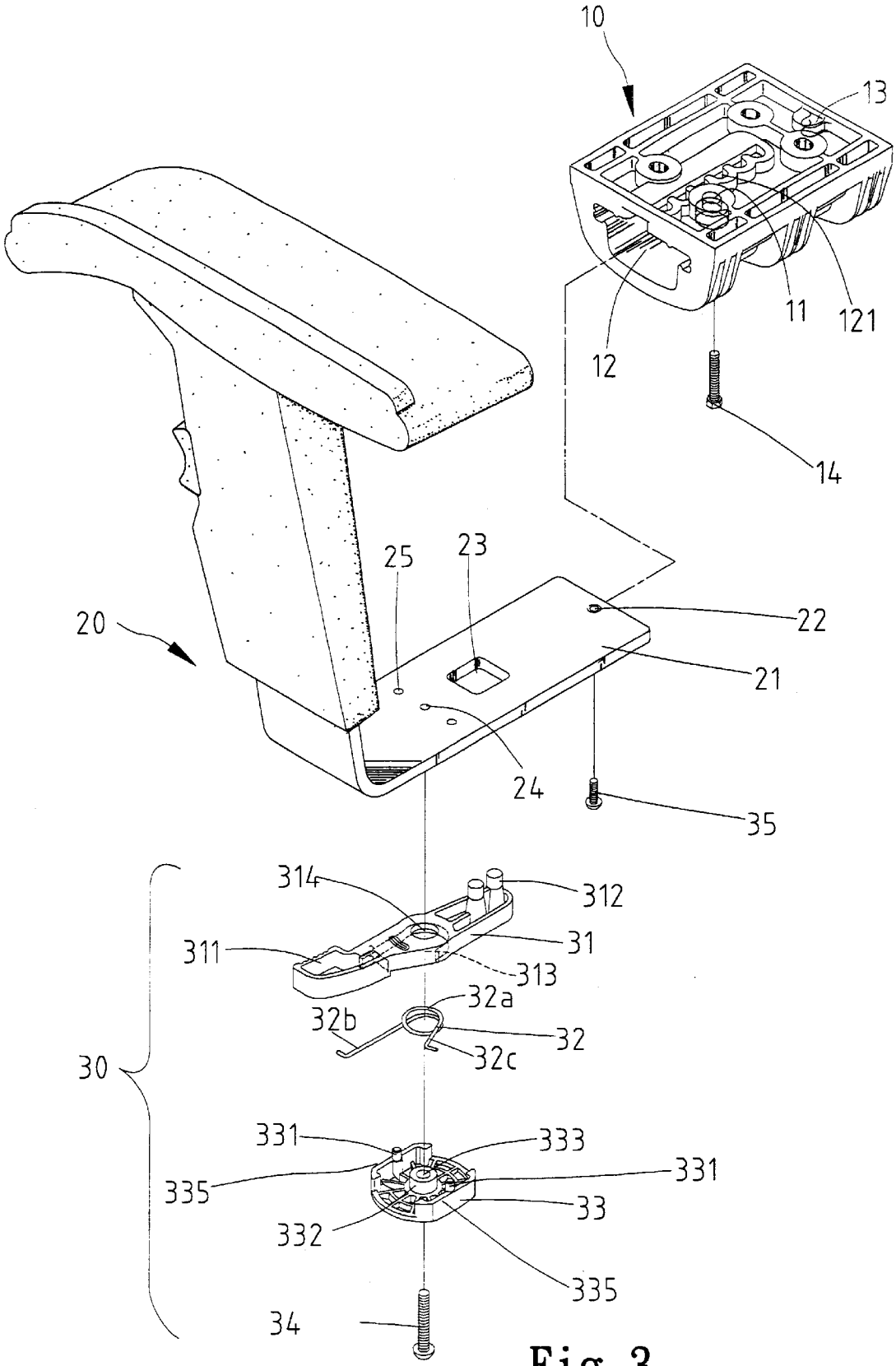
FIG. 3 is an exploded perspective view of the armrest adjusting device in accordance with the present invention.

Referring to FIGS. 1 through 3, an armrest adjusting device in accordance with the present invention generally includes a base 10 that is fixed to an underside of a chair seat (not labeled), an extension 21 extended from (or attached to) an armrest 20, and a positioning means 30. The base 10 is substantially rectangular and includes a plurality of consecutive positioning holes 121 and a longitudinal hole 12 that are communicated with the positioning holes 121. The base 10 further includes a stop 13 on an end thereof, which will be described later.

The extension 21 extended from the armrest 20 is slidably received in the longitudinal hole 12. Thus, the extension 21 and the armrest 20 are slidable in a lateral direction relative to the chair seat. The extension 21 includes a screw hole 22 to which a screw or bolt 35 is mounted. The extension 21 further includes an opening 23, a screw hole 24, and two engaging holes 25, which will be described later.

The positioning means 30 includes a positioning member 31, an elastic element 32, a mounting member 33, a bolt 34, and a bolt 35. As illustrated in FIG. 3, the positioning member 31 includes a first operative end 311 and a second end with two protrusions 312. The positioning member 31 further includes a recessed area 313 in an intermediate portion of an underside thereof, and a through-hole 314 is defined in a central area of the recessed area 313. The mounting member 33 is substantially U-shape and includes two lateral walls 335 each having a peg 331 formed thereon and a central stub 332 with a hole 333. The elastic element 32 is a torsion spring having a coil portion 32*a* and two legs 32*b* and 32*c*.

Figure 4:
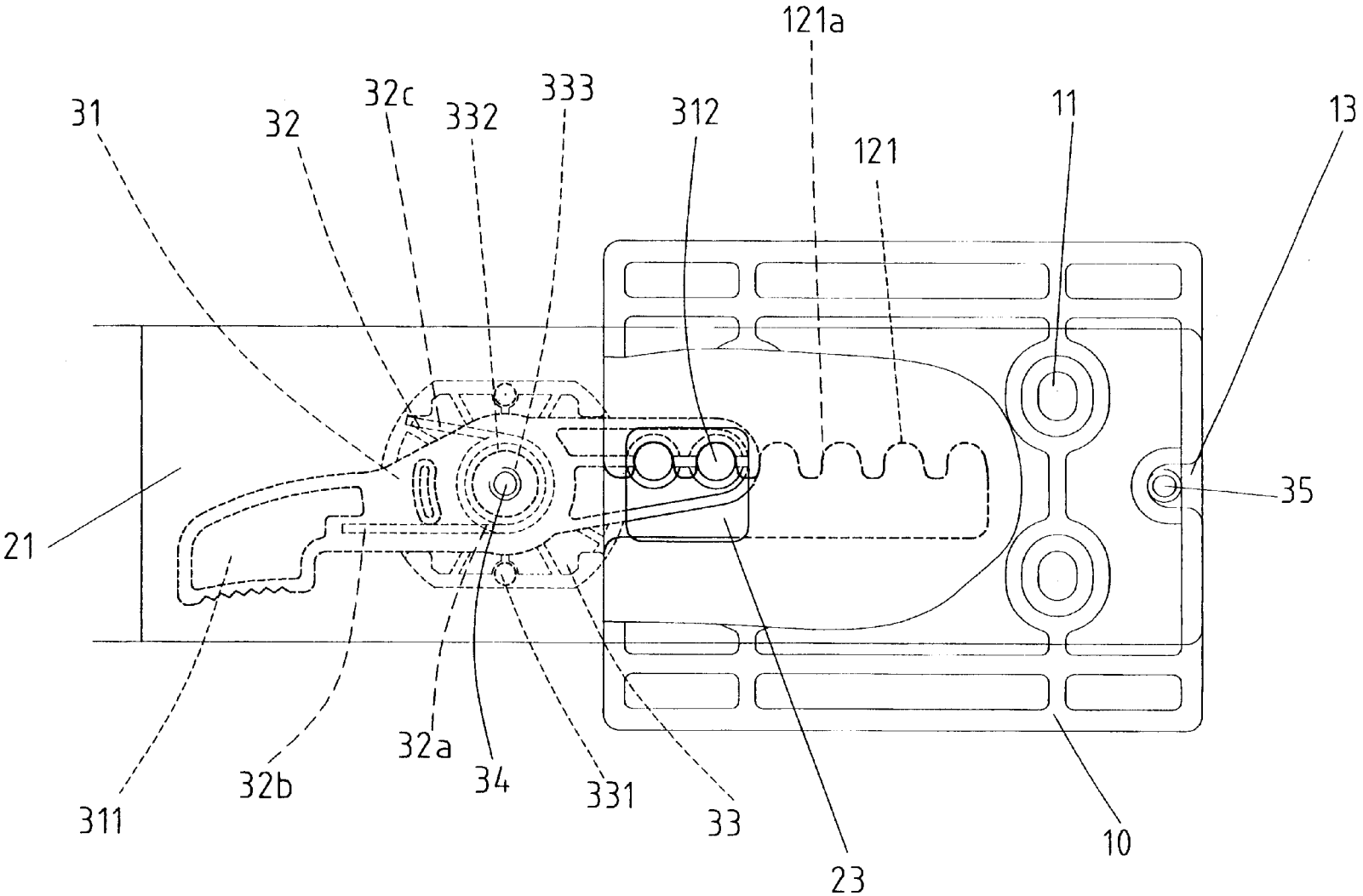
FIG. 4 is a bottom view of the armrest adjusting device in accordance with the present invention.

In assembly, bolts 14 are extended through holes 11 in the base 10 and thus securely attach the base 10 to an underside of the chair seat. Then, the elastic element 32 is mounted in the recessed area 313 of the positioning member 31, and the mounting member 33 is mounted to the underside of the positioning member 31 with the central stub 332 extended through the coil portion 32*a*. It is noted that the leg 32*b* of the elastic element 32 is attached to a lateral wall (not labeled) defining the recessed area 313 and the leg 32*c* of the elastic element 32 is attached to one of the lateral walls 335 of the mounting member 33, best shown in FIG. 4. The two protrusions 312 of the positioning member 31 extend through the opening 23 of the extension 21 (which is mounted in the longitudinal hole 12 of the base 10) and engaged with two positioning holes 121 of the base 10. The bolt 34 is extended through the hole 333 of the stub 332, the coil portion 32*a* of the elastic element 32, the through-hole 314 of the positioning member 31, and engaged with the screw hole 24 of the extension 21. It is further noted that the two pegs 331 of the mounting member 33 are engaged with the engaging holes 25 of the extension 21 to securely attach the mounting member 33 to the extension 21 while allowing pivotal movement of the positioning member 31.

Figure 5:
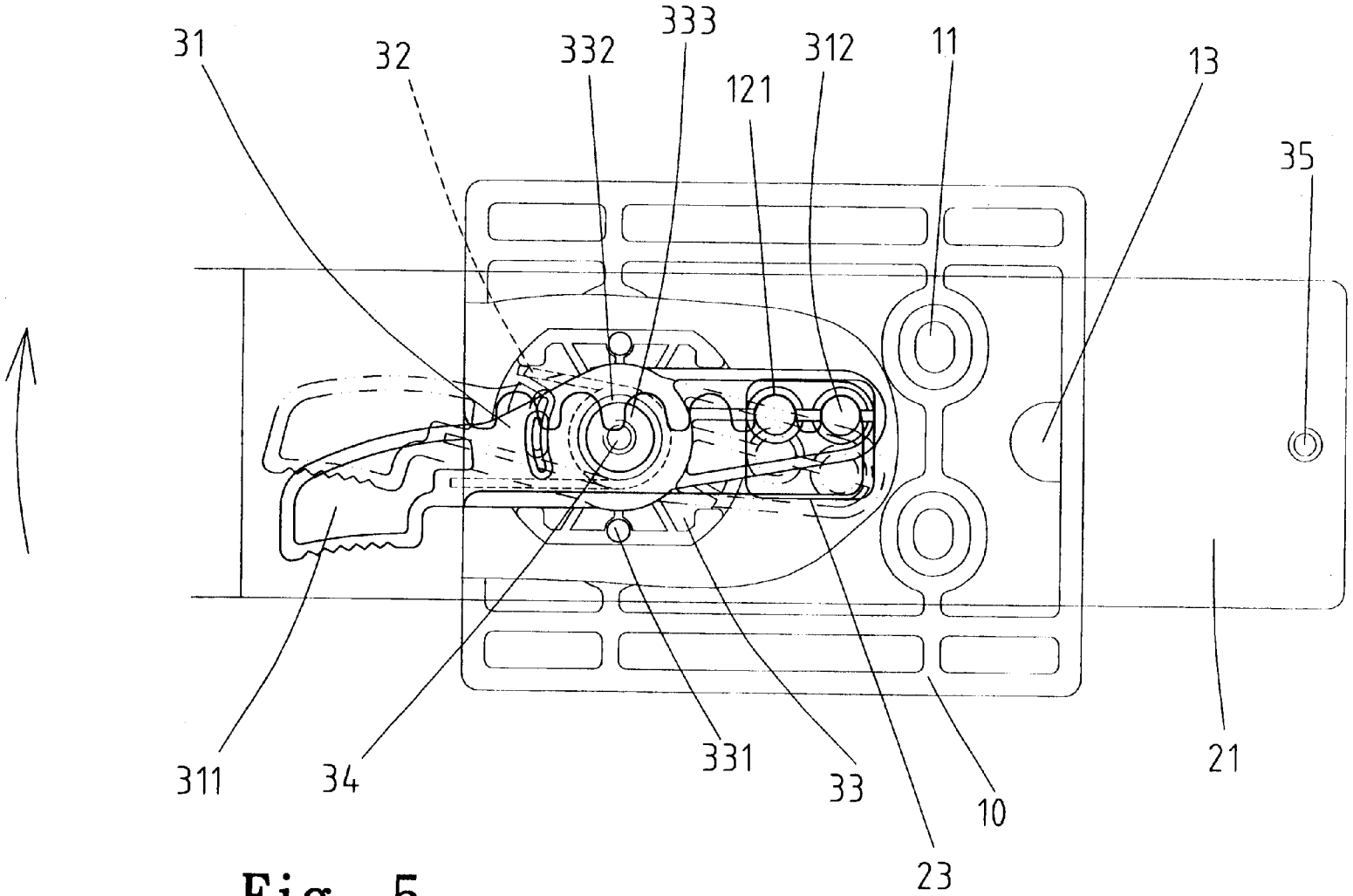
FIG. 5 is a view similar to FIG. 4, illustrating pivotal movement of a positioning member, wherein the armrest is in a different position.
Figure 6:
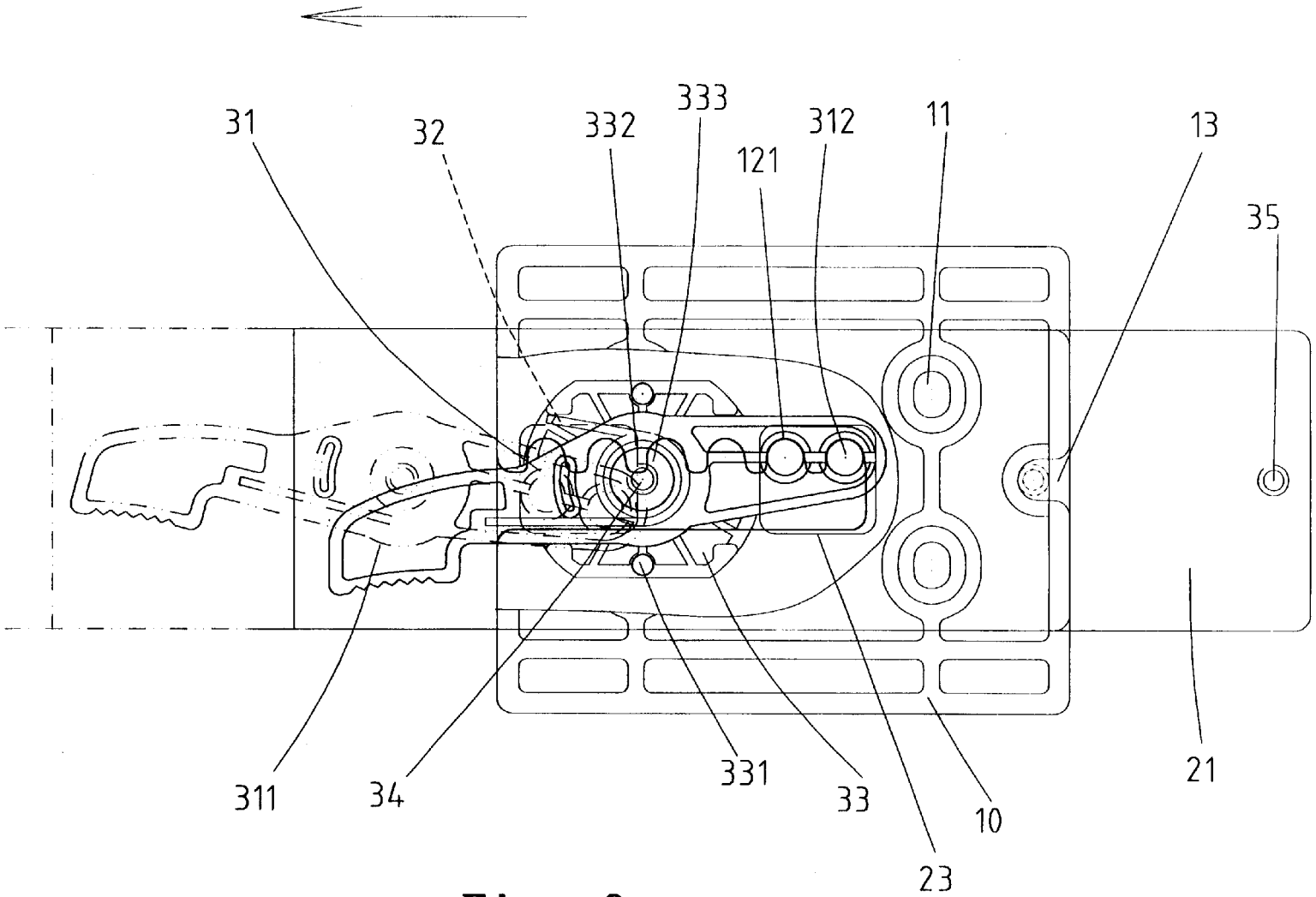
FIG. 6 is a view similar to FIG. 5, illustrating lateral movement of the armrest.
Figure 7:
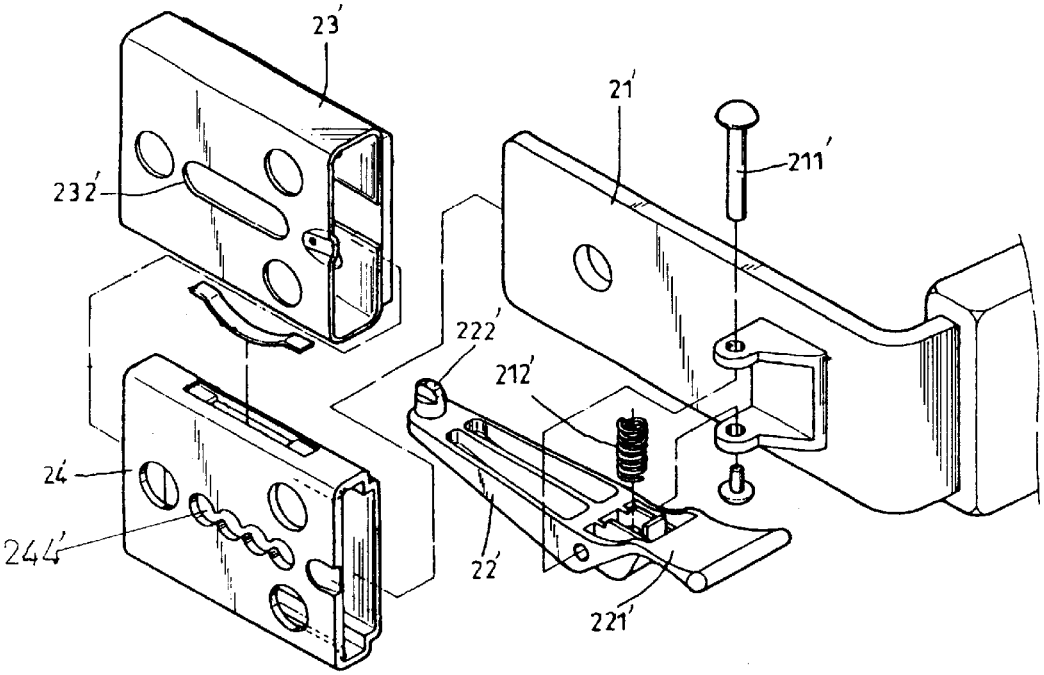
Fig. 7 PRIOR ART
FIG. 7 is an exploded perspective view of a conventional device for adjusting lateral position of a chair armrest.
Figure 8:
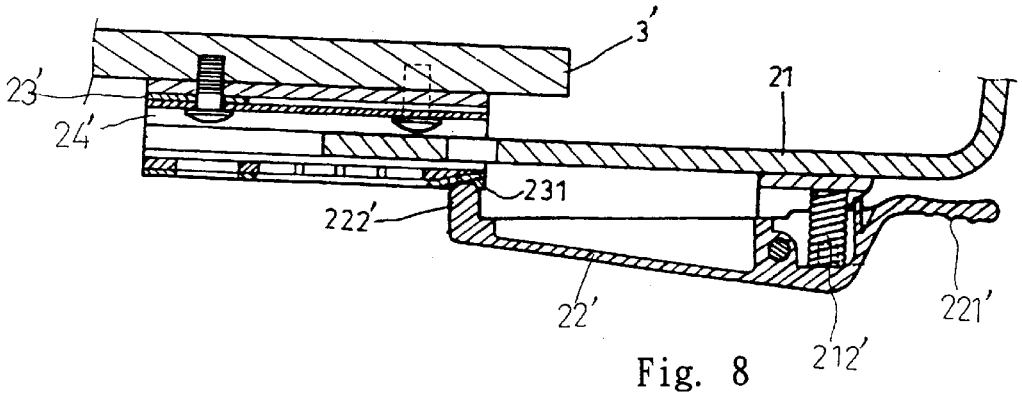
Fig. 8 PRIOR ART
FIG. 8 is a sectional view of the conventional device in FIG. 7 attached to a chair seat.

In operation, as illustrated in FIG. 5, the user may pivot the positioning member 31 at the operative end 311 to compress the elastic element 32. The protrusions 312 of the positioning member 31 are disengaged from the positioning holes 121 of the base 10 and thus allows the extension 21 to slide in the longitudinal hole 12 of the base 10 in a lateral direction relative to the chair seat. Thus, the user may adjust the distance between the two armrests in response to his/her size. The positioning member 31 is then released such that the protrusions 312 of the positioning member 31 are engaged with two associated positioning holes 121. It is noted that lateral outward movement of the extension 21 (i.e., the armrest 20) is limited by the stop 13 that will stop the bolt 35 when the armrest 20 reaches its outmost position (see FIGS. 4 and 6). This avoids disengagement of the armrest extension 21 from the base 10 attached to the chair seat.

According to the above description, it is appreciated that disengagement of the armrest extension 21 from the base 10 attached to the chair seat is avoided. In addition, assembly of the armrest adjusting device can be easily and quickly accomplished with a screwdriver, and the adjustment is simple and fast in addition to reliable positioning effect provided by the positioning member 31. Furthermore, it is appreciated that each positioning hole 121 of the base 10 includes two guiding sides 121*a* (FIG. 4) for guiding the protrusions 312 into the associated positioning holes 121.

Although the invention has been explained in relation to its preferred embodiment, it is to be understood that many other possible modifications and variations can be made without departing from the scope of the invention as hereinafter claimed.

What is claimed is:

1. A device for adjusting lateral position of an armrest of a chair relative to a seat of the chair, the device comprising:

a base securely attached to a seat of a chair, the base including a plurality of positioning holes;

an extension extended from an armrest of the chair, the extension being slidably received in the base and slidable in a lateral direction relative to the seat; and a positioning member including an intermediate portion pivotally attached to the extension about an axis perpendicular to the extension and the lateral direction, having a first operative end, and a second end releasably engaged with at least one of the positioning holes.

2. The device as claimed in claim 1, wherein the extension includes an opening, and wherein the second end of the positioning member includes two protrusions extending parallel to and spaced from the axis and that are extended through the opening and releasably engaged with two of the positioning holes of the base.

3. The device as claimed in claim 1, wherein the extension includes a screw hole, the positioning member including a recessed area in an intermediate portion of an underside thereof, the recessed area having a through-hole, a mounting member mounted to the recessed area of the positioning member and having a stub extended through the through-hole, and a bolt extended through the stub and engaged with the screw hole, thereby pivotally mounting the positioning member between the extension and the mounting member.

4. The device as claimed in claim 3, wherein the extension further includes at least one engaging hole, and wherein the mounting member includes at least one peg for engaging with said at least one engaging hole.

5. The device as claimed in claim 3, further comprising an elastic element having a coil portion mounted around the stub of the mounting member, a first leg attached to the positioning member, and a second leg attached to the mounting member.

6. The device as claimed in claim 3, wherein the extension includes two engaging holes, the mounting member including two lateral walls each having a peg for engaging with an associated said engaging hole, further comprising an elastic element having a coil portion mounted around the stub of the mounting member, a first leg attached to one of the lateral wall of the positioning member, and a second leg attached to the mounting member.

7. The device as claimed in claim 2, wherein each said positioning hole of the base includes two lateral guiding sides for guiding said protrusions of the positioning member.

8. The device as claimed in claim 1, further comprising:

means for preventing disengagement of the extension from the base during sliding movement of the extension relative to the seat.

9. A device for adjusting lateral position of an armrest of a chair relative to a seat of the chair, the device comprising:

a base securely attached to a seat of a chair, the base including a plurality of positioning holes;

an extension extended from an armrest of the chair, the extension being slidably received in the base and slidable in a lateral direction relative to the seat;

a positioning member including an intermediate portion pivotally attached to the extension, a first operative end, and a second end releasably engaged with at least one of the positioning holes, the positioning member further including an underside and a through-hole in an intermediate portion thereof;

a mounting member mounted to the underside of the positioning member and having a stub extended through the through-hole;

a bolt extended through the stub and engaged with the extension, thereby pivotally mounting the positioning member between the extension and the mounting member.

10. The device as claimed in claim 9, wherein the extension includes an opening, and wherein the second end of the positioning member includes two protrusions that are extended through the opening and releasably engaged with two of the positioning holes of the base.

11. The device as claimed in claim 9, wherein the extension further includes at least one engaging hole, and wherein the mounting member includes at least one peg for engaging with said at least one engaging hole.

12. The device as claimed in claim 9, further comprising an elastic element having a coil portion mounted around the stub of the mounting member, a first leg attached to the positioning member, and a second leg attached to the mounting member.

13. The device as claimed in claim 9, wherein the extension includes two engaging holes, the mounting member including two lateral walls each having a peg for engaging with an associated said engaging hole, further comprising an elastic element having a coil portion mounted around the stub of the mounting member, a first leg attached to one of the lateral wall of the positioning member, and a second leg attached to the mounting member.

14. The device as claimed in claim 9, further comprising means for preventing disengagement of the extension from the base during sliding movement of the extension relative to the seat.

15. The device as claimed in claim 14, wherein the preventing means includes a screw hole defined in the extension, a screw engaged with the screw hole, and a stop formed on the base for engaging with the screw when the extension is moved to an outmost position relative to the seat of the chair.

16. A device for adjusting lateral position of an armrest of a chair relative to a seat of the chair, the device comprising:

a base securely attached to a seat of a chair, the base including a plurality of positioning holes;

an extension extended from an armrest of the chair, the extension being slidably received in the base and slidable in a lateral direction relative to the seat;

a positioning member including an intermediate portion pivotally attached to the extension, a first operative end, and a second end releasably engaged with at least one of the positioning holes;

a screw hole defined in the extension;

a screw engaged with the screw hole; and a stop formed on the base for engaging with the screw when the extension is moved to an outmost position relative to the seat of the chair for preventing disengagement of the extension from the base during sliding movement of the extension relative to the seat.

* * * * *